US005512889A

United States Patent [19]

Fletcher

[11] Patent Number: 5,512,889

[45] Date of Patent: Apr. 30, 1996

[54] DOWNHOLE INSTRUMENTS FOR WELL OPERATIONS

[75] Inventor: Paul A. Fletcher, Richardson, Tex.

[73] Assignee: Atlantic Richfield Company, Los Angeles, Calif.

[21] Appl. No.: 248,295

[22] Filed: May 24, 1994

[51] Int. Cl.[6] ..... G01V 1/00

[52] U.S. Cl. ..... 340/854.6; 340/854.5; 340/854.4; 175/40

[58] Field of Search ..... 340/854.5, 854.6, 340/854.4, 854.8; 175/40

[56] References Cited

U.S. PATENT DOCUMENTS

| | | | |
|---|---|---|---|
| 3,967,201 | 6/1976 | Rorden | 340/854.5 |
| 4,691,203 | 9/1987 | Rubin et al. | 340/856 |
| 5,091,725 | 2/1992 | Gard | 340/854.1 |
| 5,394,141 | 2/1995 | Soulier | 340/854.4 |

*Primary Examiner*—J. Woodrow Eldred

*Attorney, Agent, or Firm*—Michael E. Martin

[57] ABSTRACT

Pressure and temperature signals are transmitted between a predetermined point in a wellbore and the earth's surface by an electromagnetic wave transmitter disposed in the well and connected to a bow-spring centralizer forming one contactor of a dipole and a mandrel or hanger connected to a landing nipple of a tubing string in the well whereby the other conductive path forming the other end of the dipole may be formed by a packer or similar mechanism in conductive engagement with the tubing string and the well casing. The hanger may be a lock mandrel or a suitable conventional downhole tool hanger. The electromagnetic wave transmitter may be deployed in the well and engaged with the casing by spaced-apart magnets to establish the conductive path and the dipole distance. The transmitter may also be deployed on and connected to coilable tubing which has an insulative coating on the exterior surface for a predetermined length to prevent short-circuiting the conductive path by engagement of the coilable tubing with the casing wall, for example.

8 Claims, 2 Drawing Sheets

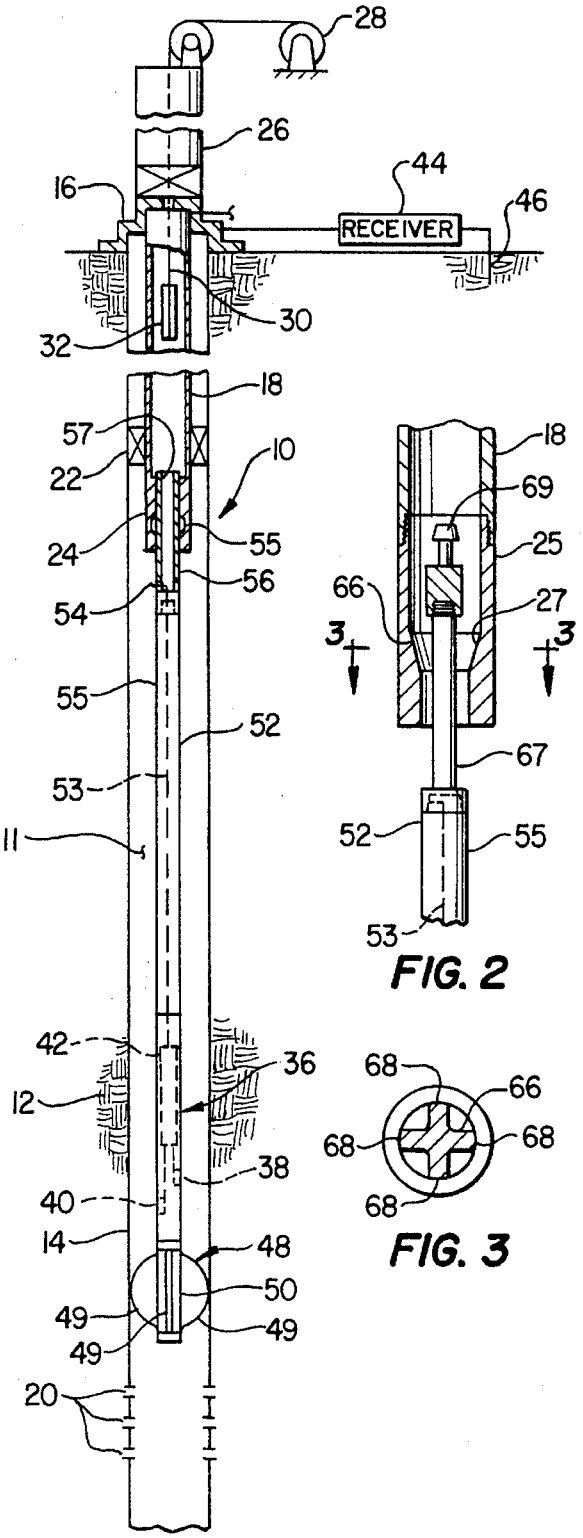
FIG. 1
FIG. 2
FIG. 3
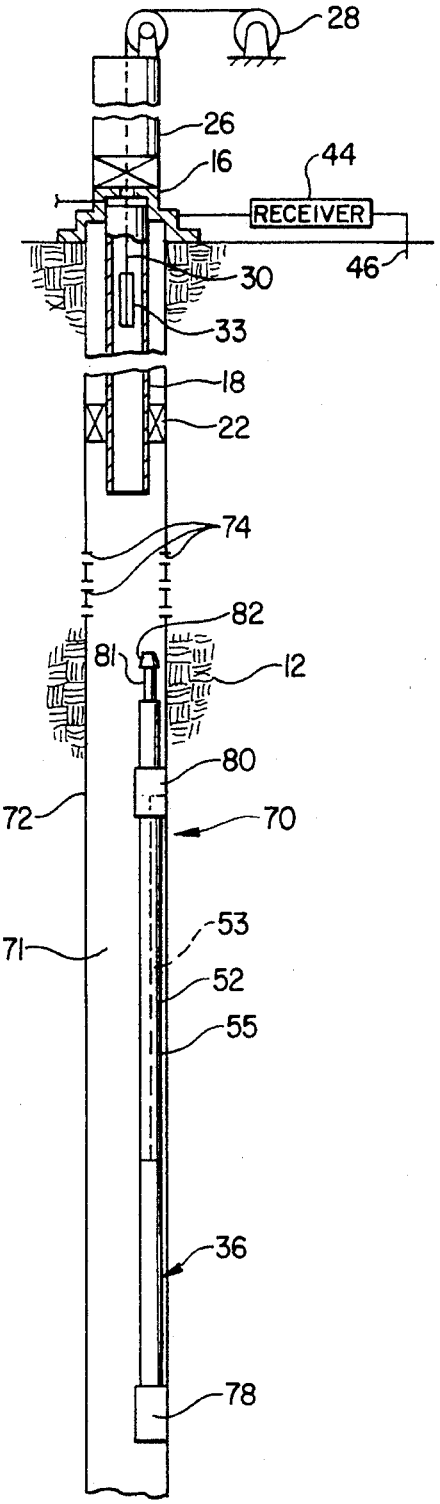
FIG. 4

DOWNHOLE INSTRUMENTS FOR WELL OPERATIONS

BACKGROUND OF THE INVENTION

1. Field of the Invention

The present invention pertains to certain arrangements of a downhole instrument for sensing well pressures and temperatures, for example, and transmitting signals related thereto by electromagnetic waves to the surface so that wellbore operations can be carried out based on substantially real-time measurements of downhole conditions.

2. Background

Many wellbore operations benefit from real-time or near real-time measurement of downhole conditions, for example, operations such as testing the rate of pressure build-up in the wellbore of an oil or gas production well and pressure and temperature conditions in the wellbore during formation fracturing or treatment operations. Although wellbore instruments have been developed which are connected to a signal conducting cable extending to the surface through the well tubing, such arrangements are not convenient for well operations where fluids are being injected into the well since the cable may interfere with fluid flow and may be damaged by abrasive substances in the fluid or the chemistry of the fluid. Moreover, the expense associated with deploying such instruments is considerable in many well operations.

Other types of instruments have been developed which may be deployed in the well and disconnected from a conveying cable or tubing and then retrieved at a later time. However, these instruments, which have a memory circuit for storing data related to conditions sensed in the well, do not provide real-time information during well operations. The importance of real-time information for certain well operations is described in U.S. patent application Ser. No. 08/169,697, filed Dec. 20, 1993 and entitled: "A Method for Real-Time Process Control of Well Stimulation" by Carl T. Montgomery and Yih-Min Jan and assigned to the assignee of the present invention.

One type of instrument which has been developed for deployment in wellbores provides substantially real-time information or data to the surface and does not require to be connected to a conductive cable extending from the instrument to the surface through the well interior. Such an Instrument includes an electromagnetic wave transmitter adapted to be deployed in a wellbore and capable of transmitting substantially real-time data concerning wellbore conditions to the surface by of a modulated electrical signal transmitted through the earth. U.S. Pat. No. 5,091,725 to Michael F. Gard, and assigned to the assignee of the present invention, describes certain improvements in electromagnetic (EM) wave transmitters adapted for downhole wellbore operations.

Still further, a type of electromagnetic wave transmitter provided by Geoservices, Inc. of Houston, Tex. is also capable of deployment in a wellbore for transmitting electromagnetic wave signals through the earth in a manner which can provide meaningful pressure and temperature information of conditions in a well at selected locations. However, effective deployment of this type of instrument and signal transmitter in wells for certain types of operations has been heretofore undeveloped. It is to this end that the present invention is directed with a view to providing improved arrangements of deploying downhole instruments for selected well operations which improve these operations by providing real-time information at the surface concerning the conditions in the well at the general location of the instrument.

SUMMARY OF THE INVENTION

The present invention provides an improved arrangement and method of providing real-time information concerning wellbore conditions during certain types of well operations such as pressure .build-up testing, formation fracturing and certain formation treatment operations to improve fluid production or injection with respect to a particular earth formation.

In accordance with one important aspect of the present invention, selected arrangements of a downhole electromagnetic wave transmitter are provided wherein the transmitter is deployed in a wellbore in a way which permits suitable signal transmission from the transmitter to and through the earth to a receiver disposed at the surface.

In accordance with another important aspect of the present invention, an inexpensive and convenient downhole signal transmitter arrangement or assembly is provided which is easier to deploy in and retrieve from a well than certain prior art instruments.

In one embodiment of the invention, a downhole instrument which is adapted to provide real-time transmission of pressure and temperature information, for example, is provided in an assembly which may be deployed into the well through a tubing string using conventional wireline or so-called slickline equipment and methods. The instrument is effectively coupled to the well structure at predetermined positions so that an electromagnetic wave signal may be effectively transmitted through the earth to the surface and carrying the desired signal from the instrument.

The invention further includes arrangements of a downhole instrument unit which comprises an electromagnetic wave transmitter which may be deployed in the well through a conventional production or injection fluid tubing string and latched in a suitable working position using conventional deployment devices and procedures. For certain operations such as hydraulic fracturing or well stimulation treatments, the instrument may be deployed in the well and secured to the well casing by magnets, for example. Still further, an arrangement is contemplated for deployment of an electromagnetic wave transmitter which remains connected to a tubing string but which also provides for suitable contact of the instrument with the wellbore structure so that effective signal transmission into and through the earth may be accomplished.

The above-noted features and advantages of the invention, together with other superior aspects thereof will be further appreciated by those skilled in the art upon reading the detailed description which follows in conjunction with the drawing.

BRIEF DESCRIPTION OF THE DRAWING

FIG. 1 is a view, in somewhat schematic form, of a well showing one deployment of an electromagnetic wave transmitting wellbore instrument;

FIG. 2 is a detail view showing an alternate arrangement of deployment of the instrument in the well of FIG. 1;

FIG. 3 is a detail section view taken along the line 3—3 of FIG. 2;

FIG. 4 is a view showing a first alternate embodiment of an arrangement for deploying an electromagnetic wave transmitting instrument in a well;

DESCRIPTION OF PREFERRED EMBODIMENTS

Figure 5:
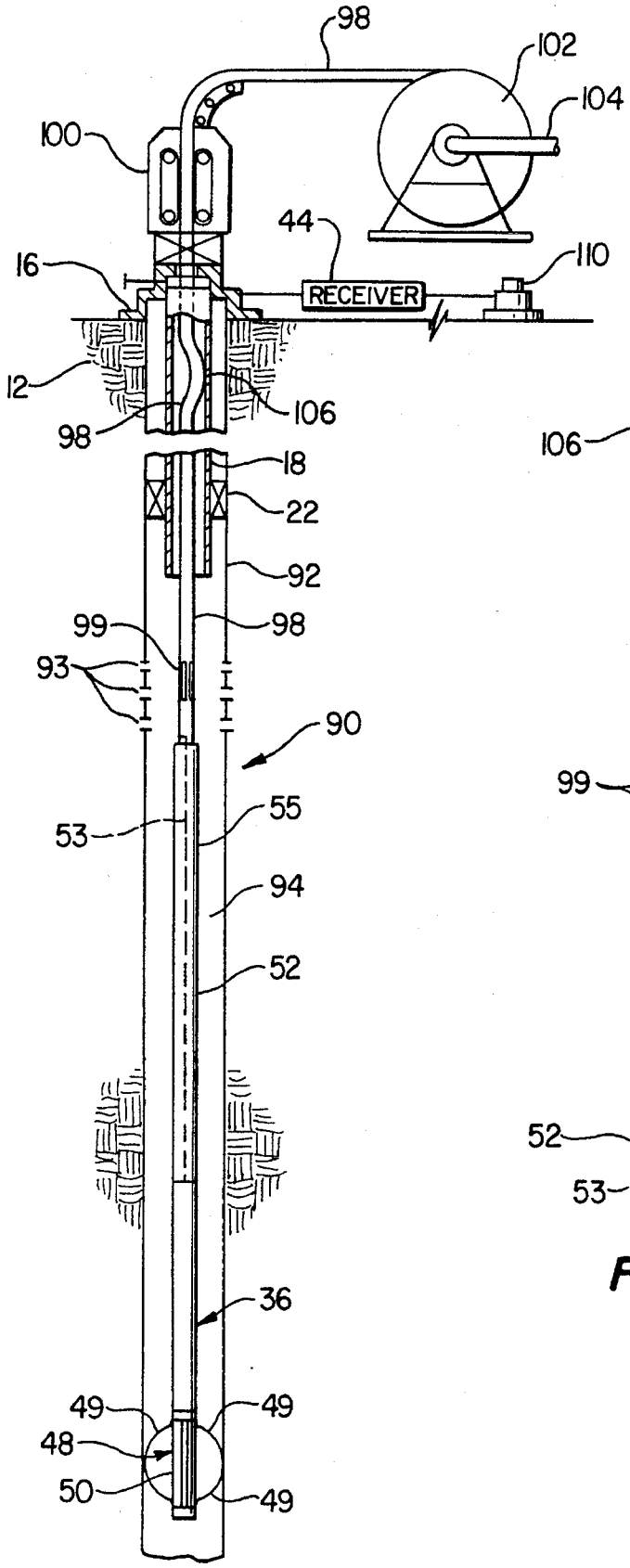
FIG. 5 is a view showing a second alternate embodiment of an arrangement of deploying an electromagnetic wave transmitting instrument in a well.
Figure 6:
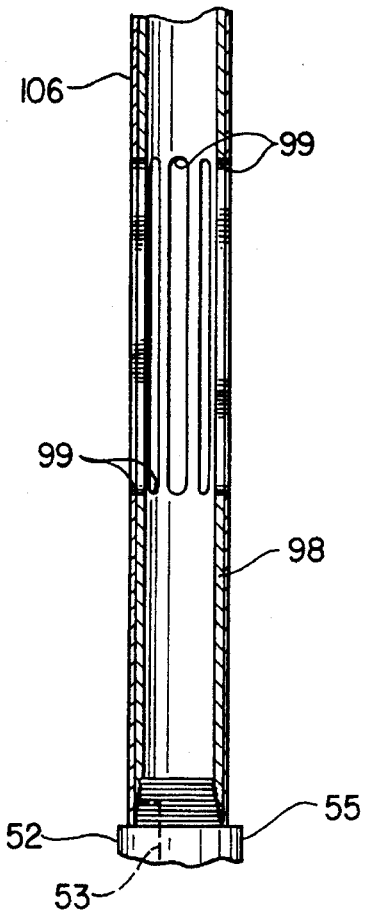
FIG. 6 is a detail view of the tubing used to deploy the instrument in the arrangement of FIG. 5.

In the description which follows, like elements are marked throughout the specification and drawing with the same reference numerals, respectively. Certain elements, including conventional devices commercially available, are shown in somewhat generalized or schematic form in the interest of clarity and conciseness.

Referring to FIG. 1, there is illustrated an arrangement wherein a fluid production well 10 extends into an earth formation 12. The well 10 includes a conventional metal casing 14 extending from a conventional wellhead 16. A production tubing string 18 also extends from the wellhead 16 to a portion of the wellbore which includes suitable perforations 20 in the casing 14 opening into the formation 12 in a fluid-producing zone, for example. The tubing string 18 is suitably secured near its lower distal end by a conventional packer 22 and the distal end of the tubing string includes a tubing section or nipple 24 which is adapted to receive certain wellbore devices. The nipple 24 may, for example, include a suitable groove or "profile" for receiving conventional latching mechanisms commercially available from suppliers such as Halliburton Company, Dallas, Tex., or Baker Hughes, Incorporated, Houston, Tex.

The wellhead 16 is shown fitted with a wireline lubricator 26 and a conventional wireline or slickline apparatus 28 is arranged in conjunction with the lubricator 26 to pay out or reel in a flexible cable or so-called "slickline" 30 having a suitable running and retrieving tool 32 connected thereto and of a type commercially available.

The arrangement illustrated in FIG. 1 is particularly adapted for real-time measurement of conditions in the wellbore 11 between the perforations 20 and the tubing string 18, for example. In many instances it is desirable, from time to time, to measure the build-up of pressure of the fluid flowing into the wellbore 11 from the perforated zone to assess the production zone conditions. In this regard, the flow of production fluid through the tubing string 18 is suitably shut off at a valve, not shown, at the wellhead 16 and the fluid pressure in the wellbore 11 is monitored. It is important to be able to monitor the pressure build-up as a function of time. In this regard in the arrangement of FIG. 1, a device 36 is shown deployed in the wellbore 11 and connected to the tubing string 18 at the landing nipple 24. The device 36 includes suitable sensors 38 and 40 for measuring pressure and temperature in the wellbore 11, for example. The sensors 38 and 40 are operable to provide suitable signals to an electromagnetic wave transmitter 42 comprising part of the device 36. The device 36 may be of a type provided by Geoservices, Inc., Houston, Tex. Alternatively, the device 36 may be similar to that described in U.S. Pat. No. 5,091,725. Electromagnetic wave signals are generated by the transmitter 42 related to signals sensed by the sensors 38 and 40 for transmission to a receiver 44 on the Earth's surface. The receiver 44 is suitably coupled to the wellhead 16 and to the earth formation 12 by an electrode or pickup device 46. The transmitter 42 is operable to inject current into the earth formation 12 by way of a contactor comprising a bow-spring centralizer 48 having plural, circumferentially spaced, elastically-deflectable bow-spring members 49 suitably mounted on a body 50 connected to the device 36, as illustrated. The bow-spring members 49 provide for effective electrical contact with the casing 14 and also serve to center or centralize the device 36 in the wellbore 11.

The device 36 also includes an elongated, generally cylindrical sub 52 which is suitably connected to a hanger comprising a tubular mandrel 54 disposed in the landing nipple 24. The sub 52 preferably includes an electrically conductive path 53 between the device 36 and the mandrel 54 but is also provided with an insulating sheath 55 to prevent electrical contact with the casing 14 at a point which would effectively degrade the signal generated by the transmitter 42 from being transmitted to the receiver 44. The length of the sub 52 is predetermined in accordance with known resistivity characteristics of the casing 14 and the earth formation 12.

The mandrel 54 is generally of a type known in the art as a so-called lock mandrel and is provided with suitable retractable locking keys 55 which are operable to releasably engage the landing nipple 24. The mandrel 54 may include suitable ports 56 formed therein whereby fluid may be conducted between the wellbore 11 and the tubing string 18 through these ports and a passage 57 formed in the interior of the mandrel. The mandrel 54 also includes suitable means, not shown, for engagement with the running and retrieval apparatus 32 for placing the device 36 in the position shown and for retrieval of the device from the wellbore 11.

The assembly of the device 36, the centralizer 50, the sub 52 and the mandrel 54 may be deployed into the well 10 in the position shown by traversing the assembly down through the tubing string 18 until the mandrel 54 is locked in its position in the landing nipple 24. The tool 32 may then be released from the mandrel 54 and retrieved uphole and out of the tubing string 18 in a conventional manner.

A dipole is formed between the centralizer 50 and the packer 22, for example, since a conductive path is provided between the device 36 through the sub 52, the mandrel 54, the nipple 24 and the tubing string 18 to the packer. Since the packer 22 is in electrically conductive engagement with the well casing 14, the length of the dipole is established between the packer and the centralizer 48. The transmitter 42 may then emit suitable electric signals by injecting current into the formation 12 through the casing 14 wherein electromagnetic waves are traversable through the formation for reception by the receiver 44, such waves being operable to carry signals related to the wellbore pressure and temperature conditions sensed by the sensors 38 and 40, respectively. Such signals are provided to the receiver 44 on substantially a real-time basis so that certain wellbore operations may be carried out, such as monitoring the rate of pressure build-up as it happens without lengthy time delays such as were necessary in retrieving tools of the prior art type. Moreover, use of a conventional slickline 30 and running/pulling tool 32 provides for convenient deployment of the device 36 in the wellbore 11 and retrieval from the wellbore when the measurement operations, such as a pressure build-up test, are completed.

Referring now briefly to FIGS. 2 and 3, there is shown a modification of the distal end of the tubing string 18 wherein a landing nipple 25 is provided in place of the landing nipple 24 and having a tapered receptacle 27 formed therein for receiving a hanger member 66 which is connected to the sub 52 by an elongated central connecting rod 67. As shown in FIG. 3, the hanger 66 has four opposed wing portions 68 which provide suitable passageways therebetween to permit fluid to flow between the wellbore 11 and the tubing string 18. The hanger 66 provides a suitable conductor between the device 36 and the tubing 18, via the path 53, to establish the dipole in the same manner that the mandrel 54 serves as a conductive path between the device 36 and the packer 22 by way of the tubing 18. The hanger 66 also includes a suitable external fishing neck 69 formed thereon for engagement with a suitable conventional running and retrieval tool, not shown, similar to the tool 32 but adapted for connection to the external fishing neck.

Referring now to FIG. 4, a first alternate embodiment of an arrangement of deployment of a downhole wellbore condition signal transmitter device is illustrated. In the arrangement of FIG. 4, there is shown a well 70 extending within the earth formation 12 from a conventional wellhead 16 and having a tubing string 18 depending from the wellhead and within a suitable casing 72. The casing 72 is suitably perforated at perforations 74, for example, whereby a formation zone of interest may be hydraulically fractured or stimulated by the injection of certain fluids down through the tubing string 18 and out through the perforations 74 into the formation. In the arrangement of FIG. 4, it is desirable to deploy the device 36 in a manner such that the device is disposed in a wellbore portion 71 below the perforations 74 so that the flow of fluids between the tubing string 18 and the perforations 74 is not impaired by the device nor is the device subject to possible damage from high-velocity flow of abrasive-laden fluids within the wellbore. In the arrangement of FIG. 4, the device 36 is connected to the sub 52 at one end and to a suitable magnet 78 at its other end. In like manner, the sub 52 is connected to a second magnet 80 at the end of the sub opposite that which is connected to the device 36. The assembly of the device 36, the sub 52 and the magnets 78 and 80 includes a suitable head part 81 including a fishing neck 82 or similar retrieval mechanism for placement of the device 36 in and retrieval from the well 70. The assembly of the device 36, together with the sub 52, the magnets 78 and 80 and the head 81, may be deployed into the well 70 using slickline 30 and a running and retrieving tool 33 by way of the lubricator 26 in a conventional manner and similar to the deployment carried out by the arrangement of FIG. 1. The tool 33 may be of a type commercially available from one of the above-mentioned sources.

When the device 36 is placed in the wellbore 71 in the position shown in FIG. 4, the tool 33 may be retrieved uphole and out of the tubing string 18, if desired, while certain hydraulic fracturing and/or stimulating procedures are carried out which call for pumping fluids under high pressure through the tubing string 18 into the wellbore 71 and out through the perforations 74. The device 36 is operable to transmit signals to the receiver 44 by injecting current into and through the casing 72 at the dipole contacts provided by the magnets 78 and 80. Accordingly, the length of the isolation sub 52 may be selected to give the appropriate dipole length required for effective signal transmission to the surface through the earth formation 12. Alternatively, the magnets 78 and 80 might be replaced by centralizers 50 to center the device 36 in the wellbore 71 and also to provide for electrically conductive contact with the metal casing 72. However, one advantage of setting the device 36 off center in the wellbore 71 and attached to the casing by the magnets 78 and 80 is that in many wellbore operations, debris may accumulate in the wellbore which requires evacuation by deployment of a tubing conveyed cleanout device down into the well to wash away the accumulated debris. With the device 36 offset to one side of the wellbore the insertion of such a cleanout device is more easily accomplished.

Referring now to FIG. 5, a second alternate embodiment of an arrangement for deployment of an electromagnetic wave transmitter is illustrated. The arrangement of FIG. 5 shows a well 90 having a metal casing 92 extending into an earth formation 12 and perforated by multiple perforations 93 to provide for fluid communication between a tubing string 18 and the selected zone of the earth formation. A wellbore portion 94 extends below the perforations 93 and is adapted to receive the device 36 in assembly with the centralizer 48 and the sub 52 deployed into the wellbore by a coilable tubing 98. The tubing 98 is adapted to be disposed in and withdrawn from the well 90 by a conventional coiled tubing injector apparatus 100 suitably mounted on the wellhead 16 in a conventional manner. The tubing 98 is operable to be reeled onto and dereeled from a suitable storage reel or drum 102 which is operable to be in communication with a source of pressure fluid through a conduit 104 whereby pressure fluid may be communicated into or from the wellbore by way of the tubing 98. The coilable tubing 98 is provided with suitable ports 99 formed therein to provide fluid communication between the wellbore 94 and the tubing whereby fluids may be injected into the formation 12 or withdrawn therefrom through the tubing 98.

The arrangement of the device 36 in FIG. 5 is such that the centralizer 48 serves as one dipole contactor by way of the bow-springs 49. The tubing 98 comprises part of a conductive path via the sub 52 and a point of engagement with the tubing 18 such as indicated at point 106 in FIG. 5. In order to control the location of the point of electrically conductive contact of the tubing 98 with the well 90, the exterior surface of the tubing 98 is covered at its lower end with a suitable non-conductive coating such as an epoxy or suitable polymer type coating for a predetermined length of the tubing extending upward from the sub 52. Since coilable tubing, for example, is not normally substantially straight under any circumstances, it is likely that the tubing might contact the interior surface of the metal casing 92 at one or more points thereby reducing the minimum dipole length to less than that which would be effective for acceptable signal transmission through the earth formation 12. Accordingly, a predetermined length of the tubing 98 is provided to be electrically non-conductive casing 92 or to any other object contacting the exterior surface of the tubing 98 so that a dipole length no less than the distance between the centralizer 48 and the packer 22 is provided.

The arrangement of FIG. 5 also shows the receiver 44 connected to the wellhead 16 and to an electrode characterized by an adjacent well 110 penetrating the earth formation 12. Accordingly, if a suitable well is located in proximity to the well 90 in which the device 36 is placed, then the metal casing of the closely adjacent well, such as the well 110, may serve as the electrode or contactor for the signal received by the receiver 44.

The arrangements for deploying an electromagnetic wave generating transmitter or device, such as the device 36 described hereinabove, are believed to be superior to prior art downhole instrument arrangements for transmitting real-time signals representing wellbore conditions to the surface whereby certain wellbore operations may be carried out more efficiently than heretofore. As mentioned previously, the device 36 including the sub 52 may be of a type commercially available. Moreover, the elements such as the centralizer 48, the mandrel 54, the running and pulling or retrieval tools 32 and 33, the hanger 66, the fishing head or neck 82, and other devices and elements associated with the present invention are known to those skilled in the art and may be commercially available or formed of conventional engineering materials used for wellbore operations. The tubing 98 may not be required to be coilable but, in any event, should be provided in a way which will assure electrically conductive contact of the tubing at some point in the tubing 18. Since most wells have some deviation throughout their length, the point of contact between the tubing 98 and the tubing 18 is usually assured at several points. In like manner, the deviated condition of many wells makes it desirable to provide the isolating sub 52 between the device 36 and the desired point of contact with the well casing of a conductive path to establish one end of the dipole.

Although the invention has been described in certain detail hereinabove, those skilled in the art will recognize that various substitutions and modifications may be made to the embodiments described without departing from the scope and spirit of the appended claims.

What is claimed is:

1. In an arrangement for a downhole instrument for transmitting data to the surface from a well, said well having a casing extending through an earth formation, said well having perforating means in said casing in communication with a predetermined zone of said earth formation, a signal transmitting device interposed in said well, comprising at least one sensor for sensing a condition in a portion of the wellbore of said well and a signal transmitter for transmitting information related to said condition to the earth's surface, a contactor connected to said device and engaged with said casing at one point, a tubing extending within said well for positioning said devices and a mandrel engaged with a landing nipple connected to said tubing for locking said device in a predetermined position in said well and for providing an electrically conductive path between said device and said casing at a predetermined distance from said contactor for establishing a dipole for the generation of electromagnetic waves in the earth by said device.

2. The invention set forth in claim 1 wherein:

said contactor comprises a centralizer connected to said device and engageable with said casing.

3. In an operation for substantially real-time monitoring of at least one of pressure and temperature in a predetermined portion of a wellbore of a well extending within the earth, the improvement characterized by:

providing an electromagnetic wave transmitting device including a first contactor connected thereto and engageable with a first wall portion of said wellbore and a second contactor connected thereto and engageable with a tubing string extending from a hanger for hanging said device within said wellbore;

connecting said device in assembly with said contactors and said hanger to a running tool and lowering said device in assembly with said contactor and said hanger into said well by a deployment line;

engaging said hanger with a landing nipple connected to said tubing string;

engaging said landing nipple with a mandrel connected to a second wall portion of said wellbore;

retrieving said deployment line from said well; and transmitting information by electromagnetic wave propagation between said device and a receiver disposed on the earth's surface.

4. In an arrangement for a downhole instrument for transmitting data from a well, said well having a casing extending through an earth formation and perforation means in said casing in communication with a predetermined zone of said earth formation, a signal transmitting device interposed in said well, comprising at least one sensor for sensing a condition in a portion of the wellbore of said well and a signal transmitter for transmitting information related to said condition to the earth's surface, and a pair of magnets connected to said device and adapted to be magnetically connected to said casing at spaced apart points, said pair of magnets supporting said device and establishing a dipole for the generation of electromagnetic waves in the earth by said device.

5. In an operation for substantially real-time monitoring of at least one of pressure and temperature in a predetermined portion of a wellbore of a well extending within the earth, the improvement characterized by:

providing an electromagnetic wave transmitting device including spaced apart magnets operably connected to said device and engageable with a wall of a casing disposed in said wellbore to support said device in said casing and provide two points of electrical contact with said casing;

connecting said device to a running tool and lowering said device in assembly with said magnets into said well by a deployment line;

engaging said magnets with said casing;

retrieving said deployment line from said well; and transmitting information by electromagnetic wave propagation between said device and a receiver disposed on the earth's surface.

6. The invention set forth in claim 1 wherein:

said contactor comprises a centralizer connected to said device and engageable with said casing.

7. The invention set forth in claim 1 wherein:

a predetermined part of said tubing includes an electrically insulative covering on the exterior thereof.

8. In an arrangement for a downhole instrument for transmitting data to the surface from a well, said well having a casing extending through an earth formation and perforation means in said casing in communication with a predetermined zone of said earth formation, a signal transmitting device interposed in said well comprising:

at least one sensor for sensing a condition in a portion of the wellbore of said well and a signal transmitter for transmitting information related to said condition to the earth's surface, a centralizer connected to said device and engaged with said casing at one point, and a hanger connected to said device and to a tubing extending within said well for positioning said device in said well and for providing an electrically conductive path between said device and said casing at a predetermined distance from said contactor for establishing a dipole for the generation of electromagnetic waves in the earth by said device, said hanger comprising means engageable with a receptacle formed in a landing nipple connected to said tubing and forming an electrically conductive path between said device and said tubing through said hanger.

* * * * *